US010895158B2

(12) United States Patent
Sanders et al.

(10) Patent No.: US 10,895,158 B2
(45) Date of Patent: Jan. 19, 2021

(54) TURBINE AIRFOIL WITH INDEPENDENT COOLING CIRCUIT FOR MID-BODY TEMPERATURE CONTROL

(71) Applicant: Siemens Aktiengesellschaft, Munich (DE)

(72) Inventors: Paul A. Sanders, Charlotte, NC (US); Brian J. Wessell, York, SC (US)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 68 days.

(21) Appl. No.: 16/317,877

(22) PCT Filed: Jul. 28, 2016

(86) PCT No.: PCT/US2016/044407
§ 371 (c)(1),
(2) Date: Jan. 15, 2019

(87) PCT Pub. No.: WO2018/022055
PCT Pub. Date: Feb. 1, 2018

(65) Prior Publication Data
US 2019/0292917 A1 Sep. 26, 2019

(51) Int. Cl.
*F01D 5/18* (2006.01)

(52) U.S. Cl.
CPC ..... *F01D 5/186* (2013.01); *F01D 5/189* (2013.01); *F05D 2250/185* (2013.01); *F05D 2260/201* (2013.01); *F05D 2260/202* (2013.01)

(58) Field of Classification Search
CPC .... F01D 5/186; F01D 5/189; F05D 2260/201; F05D 2260/202
See application file for complete search history.

(56) References Cited

U.S. PATENT DOCUMENTS 3,891,348 A * 6/1975 Auxier ..... F01D 5/189 416/97 R
5,516,260 A * 5/1996 Damlis ..... F01D 5/189 415/115

(Continued)

FOREIGN PATENT DOCUMENTS

CN 1418284 A 5/2003
CN 1477292 2/2004

(Continued)

OTHER PUBLICATIONS

PCT International Search Report and Written Opinion dated Apr. 10, 2017 corresponding to PCT Application No. PCT/US2016/044407 filed Jul. 28, 2016.

*Primary Examiner* — Ninh H. Nguyen

(57) ABSTRACT

A turbine airfoil (10) includes an elongated hollow body (26) defining a radial cavity (T1, T2) positioned in an airfoil interior (11). A pair of radial flow passes (B,E/C,D) incorporating near-wall cooling (72, 74) channels are formed on opposite sides of the elongated hollow body (26), which are in serial flow relationship conducting a coolant in opposite radial directions, forming a serpentine cooling path (60*a*, 60*b*). A downstream radial flow pass (C, D) of the serpentine cooling path (60*a*, 60*b*) is fluidically connected to the radial cavity (T1, T2). Relatively heated coolant from the serpentine cooling path is directed into the radial cavity (T1, T2) to warm the elongated hollow body (26). The coolant is subsequently discharged via impingement openings (90) on the elongated hollow body (26) into first and second impingement volumes (102, 104) that respectively adjoin the pressure and suction side walls (16, 18). A temperature gradient between the elongated hollow body (26) and the outer wall (14) is thereby reduced.

15 Claims, 3 Drawing Sheets

(56) References Cited

U.S. PATENT DOCUMENTS

| | | | | |
|---|---|---|---|---|
| 5,660,524 | A * | 8/1997 | Lee | F01D 5/182 415/115 |
| 6,238,182 | B1 | 5/2001 | Mayer | |
| 6,742,991 | B2 | 6/2004 | Soechting et al. | |
| 6,769,875 | B2 | 8/2004 | Tiemann | |
| 7,670,113 | B1 | 3/2010 | Liang | |
| 8,662,844 | B2 * | 3/2014 | Hada | F01D 5/189 416/96 A |
| 9,726,024 | B2 | 8/2017 | Buhler et al. | |
| 2016/0186587 | A1 | 6/2016 | Hagan et al. | |

FOREIGN PATENT DOCUMENTS

| | | | |
|---|---|---|---|
| CN | 104105842 | A | 10/2014 |
| JP | 2002242607 | A | 8/2002 |
| JP | 2008274906 | A | 11/2008 |
| JP | 2011111947 | A | 6/2011 |
| WO | 2015171145 | A1 | 11/2015 |
| WO | 2015195086 | A1 | 12/2015 |

* cited by examiner

VIEW II-II

TURBINE AIRFOIL WITH INDEPENDENT COOLING CIRCUIT FOR MID-BODY TEMPERATURE CONTROL

BACKGROUND

1. Field

The present invention is directed generally to turbine airfoils, and more particularly to turbine airfoils having internal cooling channels for conducting a coolant through the airfoil.

2. Description of the Related Art

In a turbomachine, such as a gas turbine engine, air is pressurized in a compressor section and then mixed with fuel and burned in a combustor section to generate hot combustion gases. The hot combustion gases are expanded within a turbine section of the engine where energy is extracted to power the compressor section and to produce useful work, such as turning a generator to produce electricity. The hot combustion gases travel through a series of turbine stages within the turbine section. A turbine stage may include a row of stationary airfoils, i.e., vanes, followed by a row of rotating airfoils, i.e., turbine blades, where the turbine blades extract energy from the hot combustion gases for providing output power. Since the airfoils, i.e., vanes and turbine blades, are directly exposed to the hot combustion gases, they are typically provided with internal cooling channels that conduct a coolant, such as compressor bleed air, through the airfoil.

One type of airfoil extends from a radially inner platform at a root end to a radially outer portion of the airfoil, and includes opposite pressure and suction side walls extending span-wise along a radial direction and extending axially from a leading edge to a trailing edge of the airfoil. The cooling channels extend inside the airfoil between the pressure and suction side walls and may conduct the coolant in alternating radial directions through the airfoil. The cooling channels remove heat from the pressure side wall and the suction side wall and thereby avoid overheating of these parts.

SUMMARY

Briefly, aspects of the present invention provide a turbine airfoil having one or more independent cooling circuits for mid-body temperature control.

According an aspect of the present invention, a turbine airfoil comprises an outer wall delimiting an airfoil interior. The outer wall extends span-wise along a radial direction of a turbine engine and is formed of a pressure side wall and a suction side wall joined at a leading edge and a trailing edge. A plurality of partition walls are positioned in the airfoil interior connecting the pressure and suction side walls along a radial extent. At least one elongated hollow body is positioned between a pair of adjacent partition walls. The elongated hollow body defines a radial cavity therewithin. First and second connector ribs are provided that respectively connect the elongated hollow body to the pressure side wall and the suction side wall along a radial extent. A serpentine cooling path is formed, comprising an upstream radial flow pass and a downstream radial flow pass in serial flow relationship conducting a coolant in opposite radial directions. Each radial flow pass comprises, in flow cross-section, a first near-wall cooling channel defined between the elongated hollow body and the pressure side wall, a second near-wall cooling channel defined between the elongated hollow body and the suction side wall, and a connecting channel defined between the elongated hollow body and a respective one of the partition walls, connecting the first and second near-wall cooling channels. The radial flow passes are fluidically connected in series and conduct a coolant in opposite radial directions to form a serpentine cooling path. The airfoil also comprises third and fourth connector ribs which respectively connect the elongated hollow body to the pressure and suction side walls along a radial extent. The third and fourth connector ribs are respectively spaced from the first and second connector ribs to define a first impingement volume and a second impingement volume. The downstream radial flow pass is fluidically connected to the radial cavity, whereby relatively heated coolant from the serpentine cooling path is directed into the radial cavity to warm the elongated hollow body. The coolant is subsequently discharged via impingement openings on the elongated hollow body into the first and second impingement volumes that respectively adjoin the pressure and suction side walls. A temperature gradient between the elongated hollow body and the outer wall is thereby reduced.

BRIEF DESCRIPTION OF THE DRAWINGS

The invention is shown in more detail by help of figures. The figures show preferred configurations and do not limit the scope of the invention.

DETAILED DESCRIPTION

Figure 1:
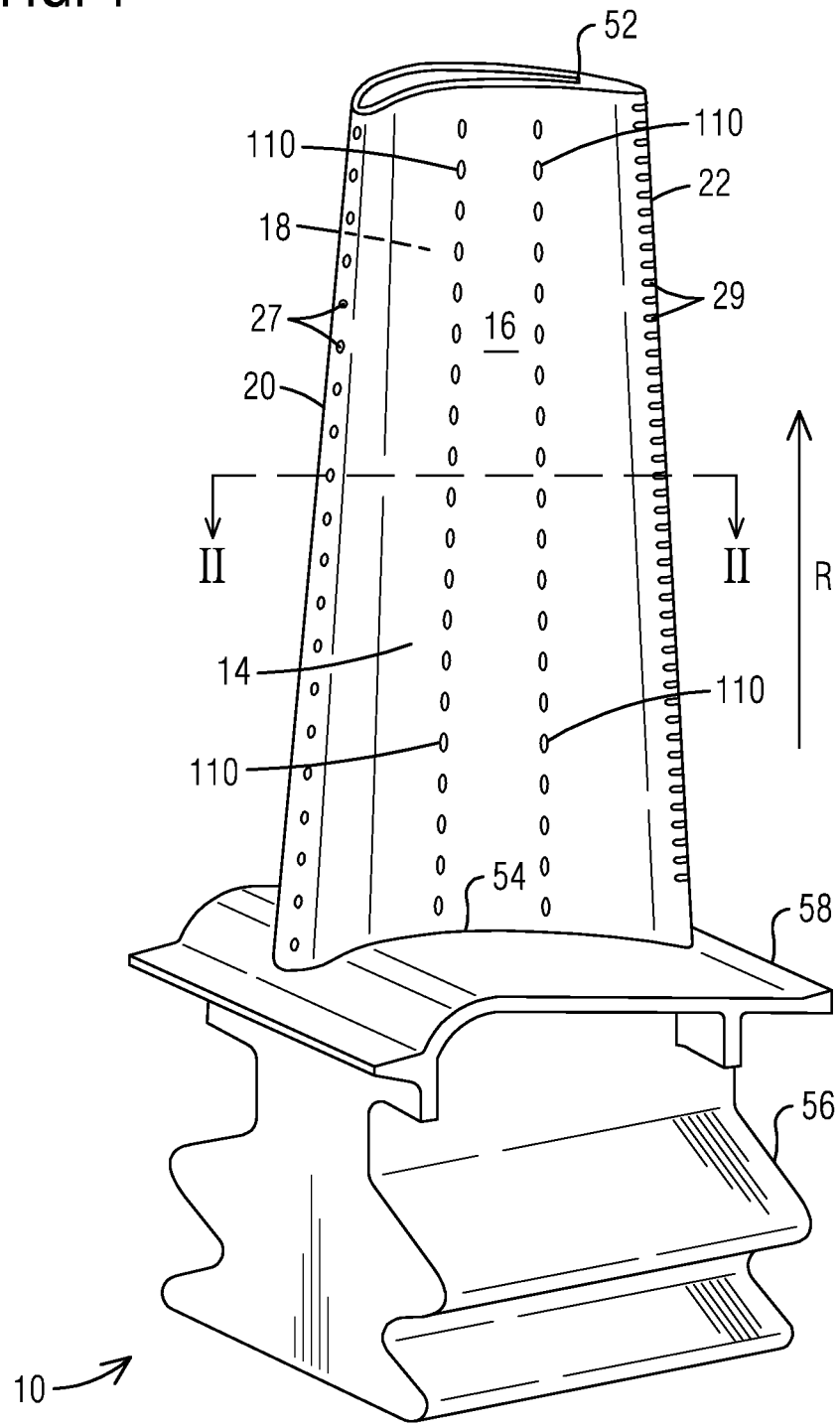
FIG. 1 is a perspective view of an example of a turbine airfoil according to one embodiment.

In the following detailed description of the preferred embodiments, reference is made to the accompanying drawings that form a part hereof, and in which is shown by way of illustration, and not by way of limitation, a specific embodiment in which the invention may be practiced. It is to be understood that other embodiments may be utilized and that changes may be made without departing from the spirit and scope of the present invention.

Aspects of the present invention relate to an internally cooled turbine airfoil. In a gas turbine engine, coolant supplied to the internal cooling channels in a turbine airfoil often comprises air diverted from a compressor section. Achieving a high cooling efficiency based on the rate of heat transfer is a significant design consideration in order to minimize the flow rate of coolant air diverted from the compressor for cooling. Many turbine blades and vanes involve a two-wall structure including a pressure side wall and a suction side wall joined at a leading edge and at a trailing edge. Internal cooling channels are created by employing internal partition walls or ribs which connect the pressure and suction side walls in a direct linear fashion. It has been noted that while the above design provides low thermal stress levels, it may pose limitations on thermal efficiency resulting from increased coolant flow due to their simple forward or aft flowing serpentine-shaped cooling channels and relatively large flow cross-sectional areas. In a typical two-wall turbine airfoil as described above, a significant portion of the radial coolant flow remains toward the center of the flow cross-section between the pressure and suction side walls, and is hence underutilized for convective cooling.

To address the problem of efficiently utilizing coolant for targeted convective heat transfer with the airfoil outer wall, techniques have been developed to implement near-wall cooling, such as that disclosed in the International Application No. PCT/US2015/047332, filed by the present applicant, and herein incorporated by reference in its entirety. Briefly, such a near-wall cooling technique employs the use of a flow displacement element in the form of an elongated hollow body to reduce the flow cross-sectional area of the coolant, thereby increasing convective heat transfer, while also increasing the target wall velocities as a result of the narrowing of the flow cross-section. Furthermore, this leads to an efficient use of the coolant as the coolant flow is displaced from the center of the flow cross-section toward the hot walls that need the most cooling, namely, the pressure and suction side walls. While the aforementioned technique works well, particularly for low coolant flow components, an improvement to the aforementioned near-wall cooling technique may be desired. The present inventors recognize that the mid-body portion of the blade is generally overcooled and could be an appropriate target for improvement. Embodiments of the present invention hence provide an improvement to the aforementioned near-wall cooling technique.

Referring now to FIG. 1, a turbine airfoil 10 is illustrated according to one embodiment. As illustrated, the airfoil 10 is a turbine blade for a gas turbine engine. It should however be noted that aspects of the invention could additionally be incorporated into stationary vanes in a gas turbine engine. The airfoil 10 may include an outer wall 14 adapted for use, for example, in a high pressure stage of an axial flow gas turbine engine. The outer wall 14 extends span-wise along a radial direction R of the turbine engine and includes a generally concave shaped pressure side wall 16 and a generally convex shaped suction side wall 18. The pressure side wall 16 and the suction side wall 18 are joined at a leading edge 20 and at a trailing edge 22. The outer wall 14 may be coupled to a root 56 at a platform 58. The root 56 may couple the turbine airfoil 10 to a disc (not shown) of the turbine engine. The outer wall 14 is delimited in the radial direction by a radially outer end face or airfoil tip 52 and a radially inner end face 54 coupled to the platform 58. In other embodiments, the airfoil 10 may be a stationary turbine vane with a radially inner end face coupled to the inner diameter of the turbine section of the turbine engine and a radially outer end face coupled to the outer diameter of the turbine section of the turbine engine.

Figure 2:
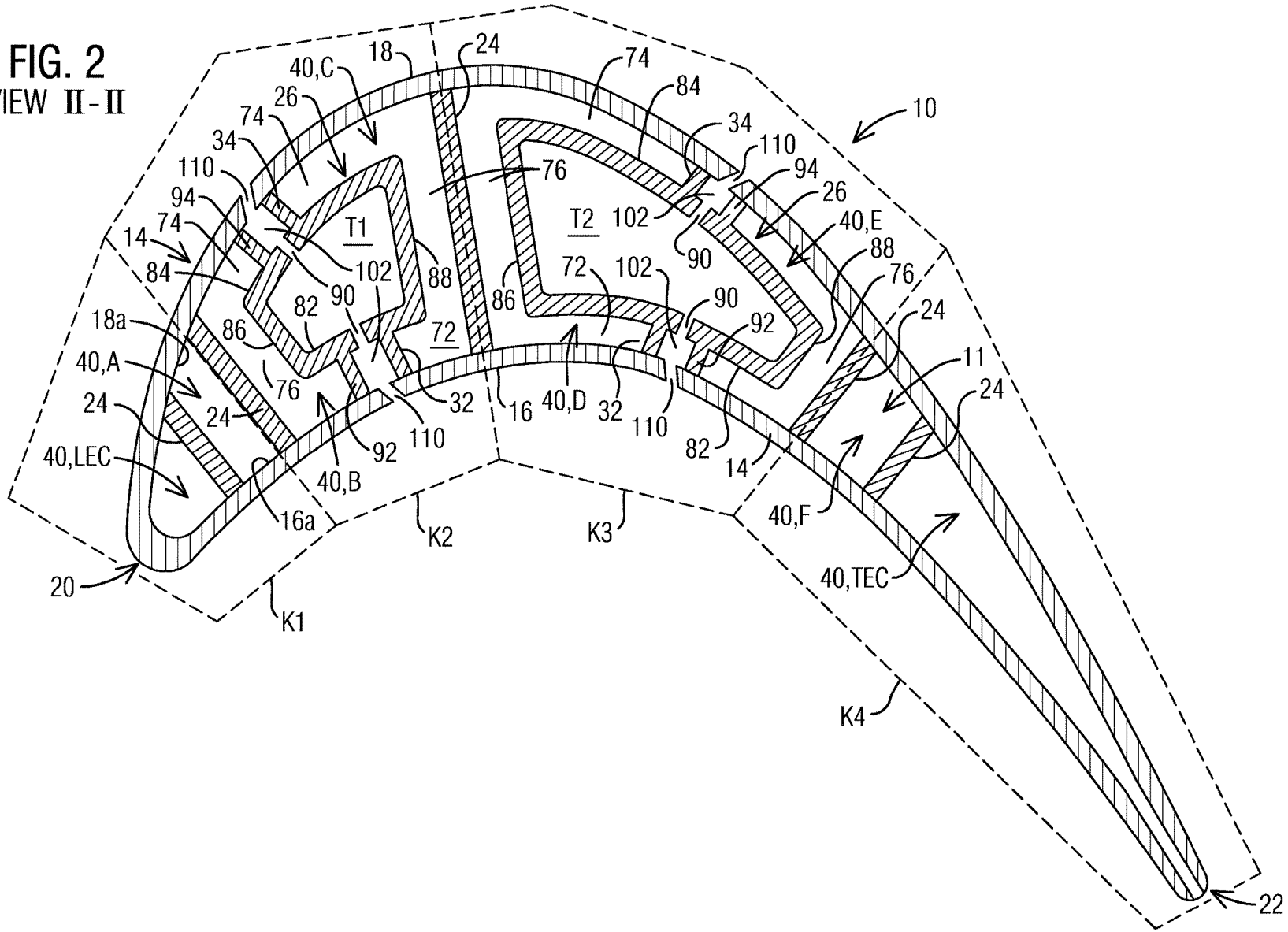
FIG. 2 is a cross-sectional view through the turbine airfoil along the section II-II of FIG. 1, illustrating aspects of the present invention.

Referring to FIGS. 1 and 2, the outer wall 14 delimits an airfoil interior 11 comprising internal cooling channels, which may receive a coolant, such as air from a compressor section (not shown), via one or more coolant supply passages (not shown) through the root 56. A plurality of partition walls 24 are positioned spaced apart in the airfoil interior 11. The partition walls 24 extend along a radial extent, connecting the pressure side wall 16 and the suction side wall 18 to define internal cavities 40. The internal cavities 40 serve as internal cooling channels which are individually identified as A, B, C, D, E, F.

Embodiments of the present invention include one or more mid-body cooling circuits in which a coolant enters the airfoil 10 from a coolant source external to the airfoil 10, such as from a compressor bleed, and traverses through at least some of the internal cooling channels, thus absorbing heat from the hot outer wall 14, before being discharged from the airfoil 10 via exhaust orifices 110 formed along the pressure side wall 16 and the suction side wall 18. In the illustrated embodiment, the exhaust orifices 110 are formed as film cooling holes. The illustrated embodiment may further include one or more passages of a leading edge cooling circuit and a trailing edge cooling circuit, which receive a coolant from an external coolant supply, independent of the mid-body cooling circuits. The leading and trailing edge cooling circuits respectively lead the coolant to a leading edge coolant cavity LEC formed adjacent to the leading edge 20 and to a trailing edge coolant cavity TEC formed adjacent to the trailing edge 22, for cooling to the leading and trailing edges 20, 22 respectively. From the cavities LEC and TEC, the coolant exits the airfoil 10 via exhaust orifices 27 and 29 positioned along the leading edge 20 and the trailing edge 22 respectively Although not explicitly shown in the drawings, it is to be understood that exhaust orifices may be provided at multiple locations, including anywhere on the pressure side wall 16, suction side wall 18 and the airfoil tip 52.

Referring to FIG. 2, one or more elongated hollow body 26 may be positioned in a respective one of the internal cavities 40. In the present example, two such elongated hollow bodies 26 are shown, each being elongated in the radial direction (perpendicular to the plane of FIG. 2) and defining a radial cavity T1, T2 therewithin. Each radial cavity T1, T2 extends radially along a span of the airfoil 10 and is capped at a first end thereof, which in this example, is near the airfoil tip 52. Due to the presence of the elongated hollow body 26 in the center of the airfoil 10, a significant portion of the coolant flow in the internal cavity 40 is displaced toward the hot outer wall 14 for effecting near-wall cooling along the pressure and suction side walls 16, 18. As shown, first and second connector ribs 32, 34 are provided that respectively connect the elongated hollow body 26 to the pressure and suction side walls 16, 18 along a radial extent. In a preferred embodiment, the elongated hollow body 26 and the first and second connector ribs 32, 34 may be manufactured integrally with the airfoil 10 using any manufacturing technique that does not require post manufacturing assembly as in the case of inserts. In one example, the elongated hollow body 26 may be cast integrally with the airfoil 10, for example from a ceramic casting core. Other manufacturing techniques may include, for example, additive manufacturing processes such as 3-D printing. This allows the inventive aspects to be used for highly contoured airfoils, including 3-D contoured blades and vanes. However, other manufacturing techniques are within the scope of the present invention, including, for example, assembly (via welding, brazing, etc.) or plastic forming, among others.

The illustrated cross-sectional shape of the elongated hollow bodies 26 is exemplary. The precise shape of an elongated hollow body 26 may depend, among other factors, on the shape of the respective cavity 40 in which it is positioned. In the illustrated embodiment, each elongated hollow body 26 comprises first and second opposite side faces 82 and 84. The first side face 82 is spaced from the pressure side wall 16 such that a first radially extending near-wall cooling channel 72 is defined between the first side face 82 and the pressure side wall 16. The second side face 84 is spaced from the suction side wall 18 such that a second radially extending near-wall cooling channel 74 is defined between the second side face 84 and the suction side wall 18. Each elongated hollow body 26 further comprises third and fourth opposite side faces 86 and 88 extending between the first and second side faces 82 and 84. The third and fourth side faces 86 and 88 are respectively spaced from the partition walls 24 on either side to define a respective connecting channel 76 between the respective side face 86, 88 and the respective partition wall 24. Each connecting channel 76 extends transversely between the first and second near-wall cooling channels 72, 74 and is connected to the first and second near-wall cooling channels 72 and 74 along a radial extent to define a flow cross-section for radial coolant flow. The provision of the connecting channel 76 results in reduced thermal stresses in the airfoil 10 and may be preferable over structurally sealing the gap between the elongated hollow body 26 and the respective partition wall 24.

As illustrated in FIG. 2, due to the volume occupied by the elongated hollow bodies 26 in the respective cavities 40, the resultant flow cross-section in each of the internal cooling channels B, C, D and E is generally C-shaped, being formed by the first and second near-wall cooling channels 72, 74 and a respective connecting channel 76. Further, as shown, a pair of adjacent internal cooling channels of symmetrically opposed C-shaped flow cross-sections are formed on opposite sides of each elongated hollow body 26. For example, the pair of adjacent internal cooling channels B, C have symmetrically opposed C-shaped flow cross-sections. A similar explanation may apply to the pair of adjacent internal cooling channels D, E. It should be noted that the term "symmetrically opposed" in this context is not meant to be limited to an exact dimensional symmetry of the flow cross-sections, which often cannot be achieved especially in highly contoured airfoils. Instead, the term "symmetrically opposed", as used herein, refers to symmetrically opposed relative geometries of the elements that form the flow cross-sections of the internal cooling channels (i.e., the near-wall cooling channels 72, 74 and the connecting channel 76 in this example). Furthermore, the illustrated C-shaped flow cross-section is exemplary. Alternate embodiments may employ, for example, an H-shaped flow cross-section defined by the near-wall cooling channels 72, 74 and the connecting channel 76. The internal cooling channels of each pair B, C and D, E may be connected in a serial flow relationship, conducting coolant in opposite radial directions, to form a respective serpentine cooling path.

Figure 3:
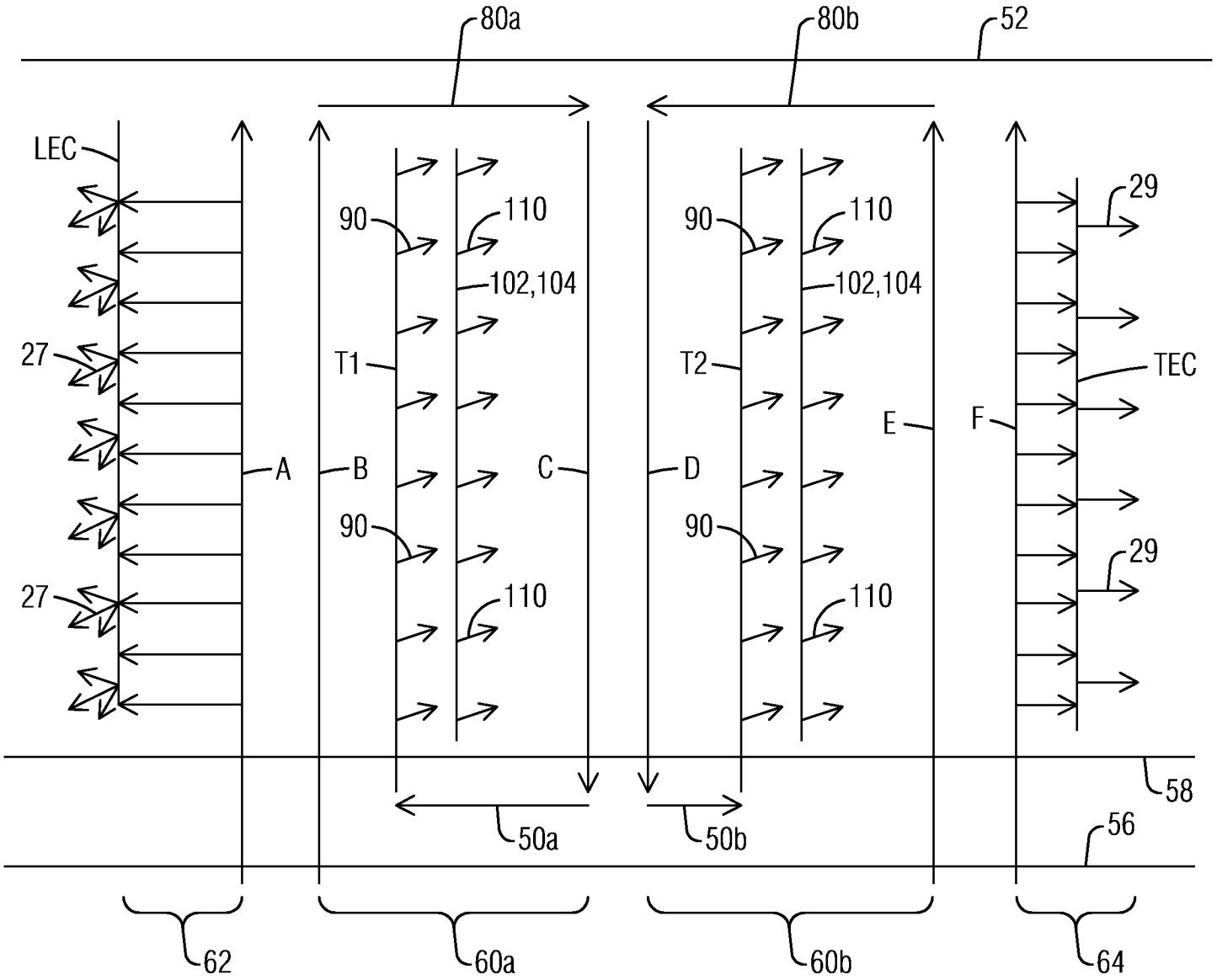
FIG. 3 is a flow diagram illustrating an exemplary flow scheme through the airfoil according to an embodiment.

FIG. 3 is a flow diagram illustrating an exemplary flow scheme through the airfoil according to an embodiment. Referring jointly to FIGS. 2 and 3, the illustrated embodiments provide an independent cooling circuit involving respective a serpentine cooling path 60*a*, 60*b* around each elongated hollow body 26 and the associated first and second connector ribs 32, 34. In the present example, a first serpentine cooling path 60*a*, extending chord-wise in a forward-to-aft direction, includes an upstream radial blow pass B and a downstream radial flow pass C, connected in series via a chord-wise flow passage 80*a*. Like-wise, a second serpentine cooling path 60*b*, extending chord-wise in an aft-to-forward direction, includes an upstream radial flow pass E and a downstream radial flow pass D, connected in series via a chord-wise flow passage 80*b*. In the example embodiment, in each serpentine flow path 60*a*, 60*b*, the upstream radial flow pass B, E is connected to a coolant source external to the airfoil 10 via a coolant supply passage in the root 56 of the airfoil (not shown). The coolant flows in the radially outboard direction in the upstream radial flow pass B, E, turns over the capped elongated radial cavity T1, T2 and flows radially inboard in the downstream radial flow pass C, D. The chord-wise flow passages 80*a-b* are formed, in this case, by a gap between the capped radial cavity T1, T2 and the airfoil tip 52. The symmetrically opposed flow cross-sections of the upstream radial flow pass B, E and the respective downstream radial flow pass C, D ensures a uniform flow turn in the chord-wise flow passages 80*a-b*.

In operation, the outer wall 14, which is directly exposed to the hot gas path, is at a much higher temperature than the elongated hollow body 26 which is positioned in the airfoil interior. In accordance with aspects of the present invention, the respective downstream radial flow pass C or D is fluidically connected, via a respective connector passage 50*a*, 50*b* to the respective radial cavity T1 or T2, for example, formed via core connection radially inboard of the platform 58. Thereby, relatively heated coolant from the serpentine cooling path 60*a*, 60*b* is directed into the radial cavity T1, T2 to warm the elongated hollow body 26. The coolant in each circuit is then impinged on to the pressure and suction side walls 16, 18 via impingement openings 90 on the walls of the elongated hollow body 26 facing the pressure and suction side walls 16, 18. A reduction in the temperature gradient between the elongated hollow body 26 and the outer wall 14 is thereby achieved. The impingement openings 90 may be arranged in an array along a span-wise extent on the wall surfaces of the elongated hollow body 26 facing the pressure and suction side walls 16, 18. In some embodiments, one or more or all of the impingement openings 90 in an array may be oriented to direct coolant to impinge on to the first and second connector ribs 32, 34 and/or the third and fourth connector ribs 92, 94.

In the illustrated embodiment, the post impingement coolant is isolated from the first and second near-wall cooling channels 72, 74. To this end, as shown in FIG. 2, each elongated hollow body 26 is associated with a third and a fourth connector rib 92, 94. The third and fourth connector ribs 92, 94 respectively connect the elongated hollow body 26 to the pressure and suction side walls 16, 18 along a radial extent. The third and fourth connector ribs 92, 94 are respectively spaced from the first and second connector ribs 32, 34 to define a first impingement volume 102 adjacent to the pressure side wall 16 and a second impingement volume 104 adjacent to the suction side wall 18. As shown in FIGS. 2 and 3, the impingement volumes 102 and 104 respectively receive the coolant post impingement on the pressure and suction side walls 16, 18. The impingement volumes 102, 104 extend radially in the airfoil 10, and are capped at a radial end of said impingement volume 102, 104, which in this case is near the airfoil tip 52. The capped ends of the impingement volumes 102, 104 ensure that the flow turning in the chord-wise flow passages 80*a-b* over said capped ends is isolated from the post impingement coolant in the impingement volumes 102, 104. The coolant in the first and second impingement volumes 102, 104 is exhausted from the airfoil 10 by way of exhaust openings 110 formed on the pressure and suction side walls 16, 18. In the illustrated embodiments, the exhaust openings 110 are configured as film cooling holes 110.

The illustrated embodiments thus provide a benefit of reducing radially thermally driven stress arising from the relatively cold walls of the elongated hollow body 26 and the hot pressure and suction side walls 16, 18. The radial cavities T1, T2, in this case, are not configured as inactive volumes but instead have preheated coolant warming the elongated hollow body 26 from the inside. Adding impingement and film cooling to the hot pressure and suction side walls 16, 18 serve to locally cool the attachment region of the connector ribs 32, 34 and 92, 94 on the pressure and suction side walls 16, 18. The above work in concert to substantially lower the temperature gradient between the outer wall 14 and the elongated hollow body 26.

The present non-limiting example shown in FIG. 2 includes four zones K1, K2, K3, K4 for independent control of flow, metal temperature and pressure loss. The above-described embodiments relate to independent cooling circuits for zones K2 and K3 located in the mid-chord region of the airfoil 10. The zones K1 and K4 may include a leading edge cooling circuit 62 and a trailing edge cooling circuit 64 as shown in FIG. 3. The cooling circuits of zones K1 and K4 receive coolant from a coolant source external to the airfoil 10 independent of the cooling circuits for zones K2 and K3. For example, the cooling circuit 62 for zone K1 may include a coolant supply passage (not shown) located in the root 56 that connects a coolant source to the internal cavity A. From the internal cavity A, the coolant may enter the leading edge coolant cavity LEC, for example via impingement openings (not shown) formed on the intervening partition wall 24, and then be discharged into the hot gas path via exhaust orifices 27 on the outer wall which collectively form a shower head for cooling the leading edge 20 of the turbine airfoil 10. The cooling circuit 64 for zone K4 may include a coolant supply passage (not shown) located in the root 56 that connects a coolant source to the internal cavity F. The internal cavity F may be in fluid communication with a trailing edge coolant cavity TEC. The trailing edge coolant cavity TEC may incorporate trailing edge cooling features (not shown), as known to one skilled in the art, for example, comprising turbulators, or pin fins, or combinations thereof, before being discharged into the hot gas path via exhaust orifices 29 located along the trailing edge 22.

It is to be noted that the illustrated cooling scheme is exemplary and other configurations may be employed. For example, while FIG. 2 illustrates four independent cooling circuits, the actual number of independent cooling circuits may be a matter of design choice. Moreover, one or more of the serpentine cooling paths 60*a*, 60*b* may be inverted in a chord-wise direction with respect to the configuration shown in FIG. 2. In yet another variation, particularly applicable in case of stationary vanes, one or more of the serpentine cooling paths 60*a*, 60*b* may be radially inverted receiving coolant supply from an outer diameter of the vane segment, with upstream flow passes being radially inboard directed and downstream flow passes being radially outboard directed.

The illustrated embodiments offer advantages of increased design flexibility to handle wider ranges of blade pressure ratio, coolant flow rates and localized cooling while maintaining a continuous flow cross-section incorporating a pair of near-wall cooling passages.

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

The invention claimed is:

1. A turbine airfoil comprising:

an outer wall delimiting an airfoil interior, the outer wall extending span-wise along a radial direction of a turbine engine and being formed of a pressure side wall and a suction side wall joined at a leading edge and a trailing edge, a plurality of partition walls positioned in the airfoil interior connecting the pressure and suction side walls along a radial extent defining a plurality of internal cavities, at least one elongated hollow body positioned between a pair of adjacent partition walls defining one of the plurality of internal cavities, the at least one elongated hollow body comprising a radial cavity therewithin, first and second connector ribs that respectively connect the elongated hollow body to the pressure side wall and the suction side wall along a radial extent, whereby an independent serpentine cooling path is formed around the at least one elongated hollow body in the one of the plurality of internal cavities, comprising an upstream radial flow pass and a downstream radial flow pass in serial flow relationship conducting a coolant in opposite radial directions, each radial flow pass comprising, in flow cross-section, a first near-wall cooling channel defined between the elongated hollow body and the pressure side wall, a second near-wall cooling channel defined between the elongated hollow body and the suction side wall, and a connecting channel defined between the elongated hollow body and a respective one of the partition walls, connecting the first and second near-wall cooling channels, third and fourth connector ribs which respectively connect the elongated hollow body to the pressure and suction side walls along a radial extent, the third and fourth connector ribs being respectively spaced from the first and second connector ribs to define a first impingement volume and a second impingement volume, wherein the downstream radial flow pass is fluidically connected to the radial cavity, whereby relatively heated coolant from the serpentine cooling path is directed into the radial cavity to warm the elongated hollow body, and is subsequently discharged via impingement openings on the elongated hollow body into the first and second impingement volumes that respectively adjoin the pressure and suction side walls, thereby reducing a temperature gradient between the elongated hollow body and the outer wall.

2. The turbine airfoil according to claim 1, wherein the impingement openings are arranged along a span-wise extent of the elongated hollow body.

3. The turbine airfoil according to claim 1, wherein at least some of the impingement openings are oriented to direct coolant to impinge on to the pressure and suction side walls.

4. The turbine airfoil according to claim 1, wherein at least some of the impingement openings are oriented to direct coolant to impinge on to the first and second connector ribs and/or the third and fourth connector ribs.

5. The turbine airfoil according to claim 1, wherein the coolant in the first and second impingement volumes is exhausted from the airfoil by way of exhaust openings formed on the pressure and suction side walls.

6. The turbine airfoil according to claim 5, wherein the exhaust openings are configured as film cooling holes.

7. The turbine airfoil according to claim 1, wherein the radial cavity and the first and second impingement volumes extend radially inside the airfoil, and are capped at one radial end thereof.

8. The turbine airfoil according to claim 7, wherein the upstream and downstream radial flow passes are fluidically connected via a chord-wise flow passage which turns coolant flow over capped ends of the radial cavity and the first and second impingement volumes.

9. The turbine airfoil according to claim 7, wherein the radial cavity and the first and second impingement volumes are capped near an airfoil tip.

10. The turbine airfoil according to claim 1, wherein the upstream radial pass is connected to a coolant supply external to the airfoil.

11. The turbine airfoil according to claim 1, wherein a downstream end of the downstream radial pass of the serpentine cooling path is fluidically connected to the radial cavity of the elongated hollow body via a connector passage located radially inboard of a platform of the airfoil.

12. The turbine airfoil according to claim 1, further comprising a leading edge cooling circuit and/or a trailing edge cooling circuit, wherein each of the leading edge cooling circuit and/or the trailing edge cooling circuit receives coolant from a coolant supply external to the airfoil independently of the serpentine cooling path.

13. The turbine airfoil according to claim 1, wherein the upstream radial flow pass and the downstream radial flow pass have symmetrically opposed flow cross-sections.

14. The turbine airfoil according to claim 1, comprising a plurality of elongated hollow bodies, each elongated body defining a radial cavity therewithin and being positioned between a respective pair of adjacent partition walls, each elongated hollow body being connected to the pressure and suction side walls along a radial extent via respective first and second connector ribs, whereby each elongated hollow body is associated with an independent serpentine cooling path, each serpentine cooling path comprising:

an upstream radial flow pass and a downstream radial flow pass in serial flow relationship conducting a coolant in opposite radial directions, each radial flow pass comprising, in flow cross-section, a first near-wall cooling channel defined between the elongated hollow body and the pressure side wall, a second near-wall cooling channel defined between the elongated hollow body and the suction side wall, and a connecting channel defined between the elongated hollow body and a respective one of the partition walls, connecting the first and second near-wall cooling channels, each elongated hollow body being further connected to the pressure and suction side walls along a radial extent via respective third and fourth ribs, the third and fourth connector ribs being respectively spaced from the first and second connector ribs to define a first impingement volume and a second impingement volume, wherein the downstream radial flow pass is fluidically connected to the radial cavity, whereby relatively heated coolant from the serpentine cooling path is directed into the radial cavity to warm the elongated hollow body, and is subsequently discharged via impingement openings on the elongated hollow body into the first and second impingement volumes that respectively adjoin the pressure and suction side walls, thereby reducing a temperature gradient between the elongated hollow body and the outer wall.

15. The turbine airfoil according to claim 14, wherein each of the serpentine cooling paths receives coolant from a coolant source external to the airfoil independent of each other and independent of a leading edge cooling circuit and a trailing edge cooling circuit of the airfoil.

* * * * *